United States Patent [19]

Mustoe

[11] 4,426,603

[45] Jan. 17, 1984

[54] HPS STARTING AID

[75] Inventor: Edward H. Mustoe, Austin, Tex.

[73] Assignee: Wide-Lite International Corporation, San Marcos, Tex.

[21] Appl. No.: 321,431

[22] Filed: Nov. 16, 1981

[51] Int. Cl.[3] ..... H05B 41/14

[52] U.S. Cl. ..... 315/289; 315/290; 315/239

[58] Field of Search ..... 315/289, 72, 209 CD, 315/290, 239; 307/108

[56] References Cited

U.S. PATENT DOCUMENTS 3,235,769 2/1966 Wattenbach ..... 315/289
4,143,304 3/1979 Hitchcock et al. ..... 315/289 X

FOREIGN PATENT DOCUMENTS 488460 1/1977 Australia ..... 315/289
52-55277 5/1977 Japan ..... 315/289

*Primary Examiner*—Eugene R. LaRoche
*Assistant Examiner*—Vincent DeLuca
*Attorney, Agent, or Firm*—Vaden, Eickenroht, Thompson, Bednar & Jamison

[57] ABSTRACT

An HPS starting aid for providing pulses to an HPS lamp via a ballast tap connection, the aid employing a capacitive voltage divider connected to the power distribution line for charging purposes. There is no power resistor so that the pulse width and amplitude is not dependent on voltage amplitude fluctuations of the line voltage. A voltage breakdown device and a timing RC network determine the pulse positioning of the starting pulse. The size of the capacitors in the capacitive voltage divider and the number of turns on the ballast tap winding determine the pulse width and amplitude.

11 Claims, 3 Drawing Figures

FIG.1
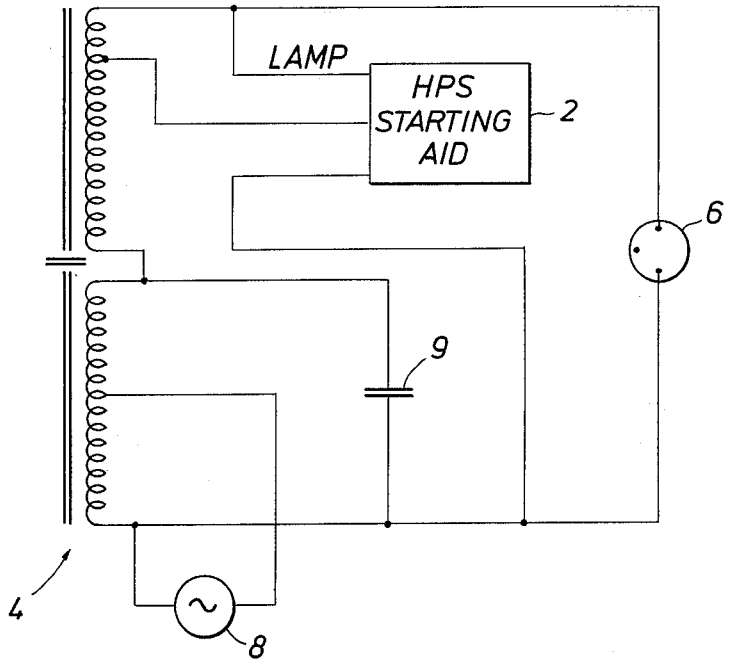
FIG. 3
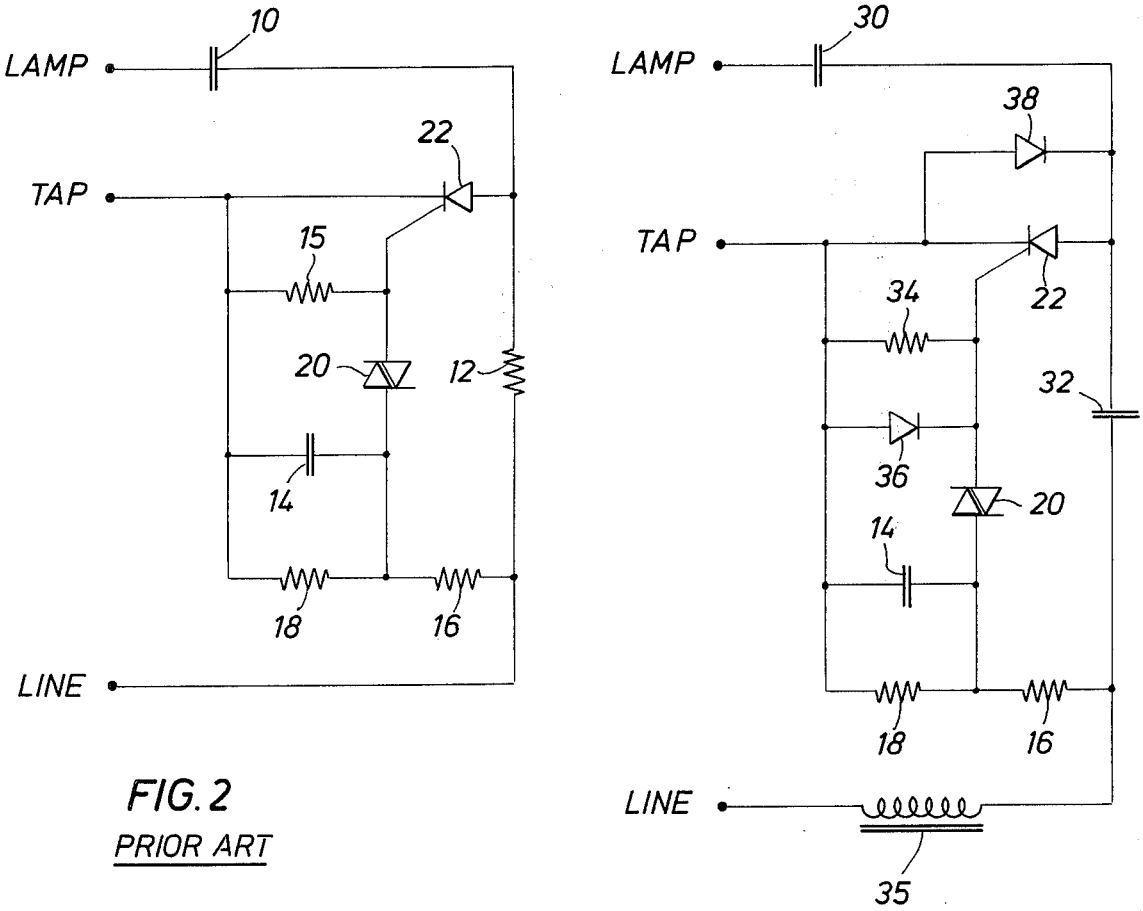
FIG. 2
PRIOR ART

HPS STARTING AID

BACKGROUND OF THE INVENTION

1. Field of the Invention

This invention relates to a circuit for starting a high intensity, gaseous discharge lamp and particularly to such a circuit that provides suitable starting pulses until such a lamp is lit and automatically removes the pulses after the arc in the lamp reaches a sustaining condition.

2. Description of the Prior Art

Some high intensity, gaseous discharge lamps require the application of suitable high voltage pulses in order to start the lamp. Typical of such lamps is the increasingly popular high pressure sodium (HPS) lamp that requires appropriate starting pulses on the order of several kilovolts. The purpose of the pulses is to initiate ionization of the gas inside the arc tube and thereby permit current to flow from the ballast. The pulses continue for a short time after initial striking of the lamp until the lamp warms up and normal operation occurs. At that time, the starting pulses can be, and usually are, removed, the operation being maintained at that point by a current flow from the ballast.

The parameters of the starting pulse are defined by the American National Standards Institute (ANSI) and relate to pulse amplitude, pulse width, pulse repetition rate and the position of the pulse with respect to the peak of the ballast ac voltage output waveform. For example, the pulse should occur in time sequence in a specified proximity with the peak of the ballast voltage waveform.

The circuits for supplying starting pulses to high pressure sodium lamps are referred to in the lighting industry as "HPS lamp starting aids". Because of the necessity of meeting the ANSI starting pulse parameters, most circuits comprise a controlled pulse discharge circuit governed by a timing circuit. Typically, such a prior art circuit includes a capacitor which is allowed to charge, and then discharge, through a portion of the windings of the ballast. By transformer action of the ballast, the pulse voltage applied thereto is stepped up to produce the desired pulse output to the lamp.

For describing more in detail a typical prior art HPS lamp starting aid, reference may be had to FIGS. 1 and 2. FIG. 1 shows typical connections for a starting aid 2 with respect to a ballast 4, lamp 6, power distribution line 8 and, in most cases, a power factor capacitor 9. FIG. 2 shows the typical components of a prior art starting aid, which is connected in FIG. 1 as aid 2. When the lamp is off, it appears as an open circuit to the ballast and to aid 2. Capacitor 10 charges up through power resistor 12 connected to the "line" connection. At the same time, capacitor 14 is charged through resistor 16. A resistor 18 is connected in parallel with capacitor 14 and, hence, controls the charging rate of capacitor 14 and also allows capacitor 14 to more completely discharge at the time of discharge.

When the voltage on capacitor 14 becomes sufficiently large so as to exceed the breakover voltage of diac or silcon bilateral switch 20, then this device conducts and supplies gate voltage to thyristor 22. Thyristor 22 has typically been an SCR in the prior art. The conduction of SCR 22 discharges capacitor 10 therethrough, thereby applying a pulse to the "tap" connection of the ballast and, hence, through a few windings thereof. Resistor 15 is connected between the gate of SCR 22 and the "tap" connection of the transformer. It is the gate return resistor to SCR 22 and provides leakage current bypass and noise immunity. Via transformer action of the ballast, it may be seen by referring to FIGS. 1 and 2 together that the appropriate pulse is applied to lamp 6, lamp 6 also being connected to the "lamp" connection of the ballast.

Assuming that thyristor 22 is a typical SCR unidirectional device, the timing/discharge cycle or sequence just described occurs 60 times per second for applied power at 60 Hz on the power distribution line. A bilaterally conducting thyristor would produce 120 pulses per second. Each cycle starts at zero ballast output voltage. As noted above, the starting pulse is required by ANSI standards to be present when the ballast output voltage is at or near its peak value.

When the starter aid just described initiates ionization of the gas in the lamp, ballast current begins to flow and the ballast output voltage drops and remains low during normal lamp operation. This normal operating ballast output voltage is not high enough to allow capacitor 14 to charge to the breakover voltage of diac 20. Therefore, the starting aid only supplies starting pulses during starting of the lamp, but not thereafter. The operation is automatic.

Although the circuit just described is useable and meets the ANSI specification for many lower-wattage ballasts, for lamp wattage of higher values, the specifications are increasingly harder to meet with the circuit described in FIG. 2. That is, it is extremely difficult to maintain the pulse position, width and amplitude at such higher wattage conditions. This is especially true, as all parameters must be met for variations in line voltage as specified by ANSI. Further, there are additional weaknesses in the circuit as a result of the presence of power resistor 12.

For example, the charge times of capacitor 10 and of capacitor 14 are dependent on and extremely sensitive to the amplitude of the voltage on the power distribution line. As this voltage amplitude varies, so does the pulse position, pulse width and the amplitude of the voltage on capacitor 10, and hence the time that SCR 22 conducts and discharges the capacitor.

A second problem with resistor 12 is that it consumes power and generates heat. This is a problem at any time, but especially under no-lamp or end-of-lamp-life conditions.

Another problem with the FIG. 2 circuit is the reliability of many of the components, especially of SCR 22 and capacitor 10, since operation in the above manner stresses each of these components greatly.

Therefore, it is a feature of the present invention to provide an improved lamp starting aid for providing pulses to a high intensity, gaseous discharge lamp which aid does not include a power resistor.

It is another feature of the present invention to provide an improved lamp starting aid for providing pulses to a high intensity, gaseous discharge lamp which reduces the number of components related to establishing pulse position, width and amplitude when compared with prior art circuits and, therefore, makes it easier to meet the ANSI specifications for such circuits at high wattage operating conditions.

SUMMARY OF THE INVENTION

The invention herein disclosed pertains to an improved lamp starting aid which is connectable to a ballast and a high intensity, gaseous discharge lamp requiring such a circuit to initiate operation, in the same manner as prior art aids.

The invention starting aid includes a capacitive voltage divider unlimited by a power resistor for quickly charging to full charge in the presence of line voltage. A thyristor, such as preferably an ASCR, is connected with its main terminals between the divider junction point and a transformer ballast tap. The gate of the thyristor is connected to a voltage breakdown device which, in turn, is triggered by a timing RC network. The RC network determines the occurrence of pulse initiation via the gated-on thyristor which pulse has a precise amplitude from the discharge of the fully charged capacitive divider. Turn off of the thyristor is through a return resistor connected from the ballast tap back to the gate, the reverse gate voltage resulting in a precision fashion from the inductive effect of the pulse operating in the ballast. The thyristor turns off when the current through it passes through zero. When the pulse is discharged through the tap, the core of the ballast senses a rapid change in flux density, thereby producing a pulse with an opposing polarity back toward the main terminals of the thyristor. The reversed voltage causes current flow to cease, turning off the thyristor. The reversed voltage also causes a charge release from the gate through resistor 34. Resistor 34 provides noise immunity and, with diode 36, provides gate protection and faster operation.

The size of the capacitors in the capacitive divider and the number of turns on the ballast between the tap and lamp connections determine the pulse width and amplitude. The components in the RC network determine the precise location of the pulse vis-a-vis the ballast output voltage, which is in phase with the applied line voltage prior to lamp starting.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

In the Drawings

FIG. 1 is a circuit connection diagram of a lamp starting aid in accordance with the present invention as connected to a high intensity, gaseous discharge lamp of the type requiring starting pulses.

FIG. 2 is a simplified schematic diagram of a lamp starting aid in accordance with the prior art.

FIG. 3 is a simplified schematic diagram of a lamp starting aid in accordance with the present invention.

DESCRIPTION OF PREFERRED EMBODIMENT

Now referring to the drawings and first to FIG. 1, a connection diagram for the starting aid to be described hereinafter is illustrated. A ballast transformer 4, typically in the form of an autotransformer, is connected with its primary winding connected so that the power distribution line is applied between a line connection and a tap of this primary winding. A power factor capacitor 9 is connected from the other end of the primary winding to the common line connection. It is common in the United States that the power distribution voltage be provided for industrial systems at a nominal 208, 240, 277 and 480 volts ac at a nominal frequency of 60 Hz. This nominal voltage value may, however, be more or less than the target voltage by several volts.

The top of secondary winding is connected to a high intensity, gaseous discharge lamp 6 of the type requiring starting pulses. Probably the most popular of such lamps is the high pressure sodium or HPS lamp. This lamp connection is also connected to HPS (or other) starting aid 2. Also connected to aid 2 is a tap connection of a few windings from the top of the secondary and a line connection to the power distribution line connection to the ballast.

As explained hereinabove, the connections shown in FIG. 1 are common to the prior art circuit illustrated in FIG. 2 as well as the invention embodiment illustrated in FIG. 3 described hereinbelow. Insofar as the circuit for FIG. 2 is concerned, reference should be made to its description in the prior art section above.

Now referring to FIG. 3, a circuit is shown comprising a capacitive divider including capacitors 30 and 32 in series with inductor 35, which functions as a pulse blocking choke. Such a choke has been used in the prior art for this purpose. In operation, capacitors 30 and 32 quickly charge to their respective voltages once power is supplied, which are in sum, equal to the total of the voltage across the entire transformer ballast. Note that these capacitors are in series across the lamp and line connections of the ballast (except for the presence of inductor 35) and there is no power resistor present in the series connection, as in the case of prior art circuits.

A thyristor 22 is connected with its main terminals between the junction of the capacitive divider and the tap connection to the ballast, as with the prior art circuit shown in FIG. 2. The gate of thyristor 22 is connected in series with diac 20, the other connection of which is connected to the output of timing capacitor 14. As with the prior art circuit, capacitor 14 is charged through resistor 16 and is controlled with respect to its charging rate and with respect to discharging by parallel resistor 18.

A resistor 34 is connected from the gate of thyristor 22 to the tap connection as a gate return resistor to provide noise immunity and leakage current bypass and to turn off the thyristor by inductive action of the ballast, as explained above in connection with resistor 15 in the FIG. 2 circuit. A diode 36 is connected in parallel with resistor 34, hence connecting the gate of thyristor 22 to the tap connection. This diode is connected with its cathode to the gate of the thyristor. This diode helps provide protection of the thyristor from inductive transients. Another diode 38 is connected with its anode to the tap connection of the ballast and its cathode to the junction point of the capacitive divider. This diode provides a path for inductive transients around the thyristor while it is cut off.

Now referring again to the operation of the circuit, when the lamp connected to the lamp connection of the ballast is not lit, capacitors 30 and 32 charge quickly to their full voltage levels and, in due time, capacitor 14 charges to the level that exceeds the voltage breakdown level of diac 20. When this occurs, thyristor 22, illustrated as an SCR, is gated on. Current from capacitor 30 begins to flow first, followed by the combining current from capacitor 32, which acts to sustain the pulse discharged through the main terminals of the thyristor to the tap connection of the ballast.

After the capacitors discharge, the inductive effect of the ballast causes thyristor 22 to turn off quickly, resistor 34 and diode 36 providing paths for removing voltage from the gate of the thyristor, as explained above. After cutoff, diode 38 passes inductive transients around thyristor 22.

It may be seen, therefore, that the combined operation of capacitors 30 and 32, the gating of thyristor 22 and diode 38 provide a strong pulse, limit thyristor stresses and minimize voltage variations that have made it difficult to meet ANSI standards for high wattage circuits. Since there is no power resistor, little heat is generated and power consumption is kept to a minimum.

The circuit just described allows optimization of the timing component values so that pulse position is less dependent on voltage. By changing the values of capacitors 30 and 32 and the number of tap turns on the ballast, pulse width and amplitude may be carefully controlled as may be required for different ballasts. By changing the values of the components in the timing network, namely, capacitor 14 and resistors 16 and 18, the pulse location can be adjusted.

The preferred component type of thyristor that is useful for thyristor 22 in the circuit of FIG. 3 is an asymmetrical SCR (ASCR). The switching speed of an ASCR is quite high and its gate characteristics make it more reliable in the circuit than other thyristors. An ASCR turns on and off more quickly than a standard SCR. This is advantageous, since the capacitive discharge current can flow in a standard SCR before the entire semiconductor junction is turned on, causing damage and junction heating by the "current crowding" effect.

Although an autotransformer is shown as the ballast in FIG. 3, the ballast tap connection may be made to an isolated winding. Moreover, diode 36 does not have to be present since resistor 34 does provide a gate return path by itself. Alternatively, a triac may be used which will conduct in both directions. When there is an isolated winding, then pulse blocking choke 35 also does not have to be present. In the preferred embodiment illustrated, if the choke were not present, the pulse would feed through capacitors 30 and 32 back to the line. The choke blocks the high voltage pulse. If there is an isolated winding, choke 35 does not have to be present, there being no common point whereby the pulse may return except through the lamp.

As mentioned above, the turns ratio of the tap connection is important in determining the pulse width and amplitude. For adapting the circuit of FIG. 3 to an existing ballast with an already set turns ratio, it is possible to modify these parameters of the pulse by adding an appropriate small resistor in the tap connection.

Although it is preferred to use an ASCR as the thyristor in the above circuit, it is possible to use a triac, an SCR, or an ITR, as well. In the latter case, there is a built in diode 38. When a bi-directional device is used, then there will be twice as many pulses as the frequency of the line. For example, for a 60 Hz line, there would be 120 pulses produced per second.

While a particular embodiment of the invention has been shown and described, it will be understood that the invention is not limited thereto, since many modifications may be made and will become apparent to those skilled in the art.

What is claimed is:

1. In combination with a high intensity, gaseous discharge lamp requiring high voltage starting pulses and a transformer ballast for operating the lamp once the lamp is lit, the improvement of a lamp starting aid being connected respectively to a ballast connection to the lamp, a ballast starting tap connection, and a ballast connection to the power distribution line, comprising a capacitive voltage divider connected in series between said lamp and line connections and unlimited by a connection to a power resistor for quickly charging to full charge in the presence of applied power on said line, a thyristor connected between the divider junction of said divider and said tap, a voltage breakdown device connected to said thyristor gate, a timing RC network connected to said voltage breakdown device and to said power distribution line, the RC network components determining the timing of the gating on of said thyristor by determining the voltage breakdown occurrence of said voltage breakdown device, the size of the capacitors in said capacitor divider and the number of turns on the ballast between said tap and lamp connections determining the pulse width and amplitude of said starting pulses.

2. A starting aid in accordance with claim 1, and including a diode connected from said tap to said divider junction, said diode providing a path for inductive transients around said thyristor while cut off.

3. A starting aid in accordance with claim 1, and including means for providing inductive gating off of said thyristor.

4. A starting aid in accordance with claim 1, and including a first diode connected from said tap to said divider junction, said first diode providing a path for inductive transients around said thyristor while cut off, and a second diode connected from said tap to said thyristor gate to provide protection of said thyristor from inductive transients.

5. A starting aid in accordance with claim 1, and including a pulse blocking choke in the ballast connection line from the power distribution line to the starting aid.

6. A starting aid in accordance with claim 1, and including a resistor in parallel with the capacitor of said RC network for controlling the charging rate and the discharge of said RC network capacitor.

7. A starting aid in accordance with claim 1, wherein said thyristor includes an asymmetrical SCR.

8. A starting aid in accordance with claim 1, wherein said thyristor includes an SCR.

9. A starting aid in accordance with claim 1, wherein said thyristor includes an ITR.

10. A starting aid in accordance with claim 1, wherein said thyristor includes a triac.

11. A starting aid in accordance with claim 1, and including a resistor in the ballast tap connection for assisting in the determination of the pulse width and amplitude of said starting pulses.

* * * * *